United States Patent [19]

Clarke et al.

[11] Patent Number: 5,000,159

[45] Date of Patent: Mar. 19, 1991

[54] SPARK IGNITED BURNER

[75] Inventors: Beresford N. Clarke; John Clarke, both of Fort Wayne, Ind.

[73] Assignee: MPI Furnace Company, Fort Wayne, Ind.

[21] Appl. No.: 495,720

[22] Filed: Mar. 19, 1990

[51] Int. Cl.[5] ..... F24C 3/00

[52] U.S. Cl. ..... 126/91 A; 431/266

[58] Field of Search ..... 431/266, 264; 126/91 A

[56] References Cited

U.S. PATENT DOCUMENTS

| | | | |
|---|---|---|---|
| 2,796,118 | 6/1957 | Parker et al. | 126/91 A |
| 2,996,113 | 8/1961 | Williams . | |
| 3,007,084 | 10/1961 | Thomasian et al. | 431/266 |
| 3,032,096 | 5/1962 | Stout | 431/264 |
| 3,361,185 | 1/1968 | Anderson et al. | 126/91 A |
| 4,431,400 | 2/1984 | Kobayashi et al. | 431/266 |
| 4,494,923 | 1/1985 | Guillaume et al. | 431/266 |
| 4,496,314 | 1/1985 | Clarke . | |
| 4,524,752 | 6/1985 | Clarke . | |
| 4,541,798 | 9/1985 | Miller et al. | 431/266 |
| 4,595,353 | 6/1986 | de Haan | 431/264 |

*Primary Examiner*—Carroll B. Dority

*Attorney, Agent, or Firm*—Pearne, Gordon, McCoy & Granger

[57] ABSTRACT

A post-mix burner having electrical ignition means is particularly adapted for use with radiant tube furnaces. The burner provides two concentric tubes which define a central passage and an annular passage around the central passage. Fuel is introduced into the central passage and primary air through the annular passage. Mixing of the primary air and fuel commences at and near the end of the inner tube. The ignition system provides a spark gap in axial alignment with the end of the inner tube where the mixing of the primary air and fuel commences. The main combustion air is introduced into the burner through an annular pasage surrounding the aforementioned passages. When combustion having substantial length is desired, the fuel and air are introduced into the burner as laminar flow with each component having the same velocity.

26 Claims, 2 Drawing Sheets

SPARK IGNITED BURNER

BACKGROUND OF THE INVENTION

This invention relates generally to burner structures and more particularly to a novel and improved post-mix burner having an electrical ignition system.

PRIOR ART

Burners are generally divided into two types: premix and post-mix In the pre-mix burner, the fuel and oxidant are mixed prior to entering the burner nozzle. In a post-mix burner, the fuel and oxidant do not mix until they are discharged into the combustion zone. The present invention is directed to a post-mix burner.

Further, the ignition system burners generally use either a pilot light or an electrical ignition system in which an electric discharge across the gap establishes a spark which ignites the fuel and oxidant mixture. Gas pilot lights are difficult to maintain because they operate at high ambient temperatures and are subject to clogging and the like. Electrical ignition systems also present problems when the electrodes are small and subject to erosion failures. Such failures are a particular problem if the electrode component must function in a high ambient temperature location. The present invention provides a novel and improved electrical ignition for the burner.

Examples of post-mix prior art burners having electrical ignition are disclosed in U.S. Letters Pat. Nos. 2,996,113, 4,431,400 and 4,541,798. Such patents are incorporated herein by reference in their entirety.

SUMMARY OF THE INVENTION

There are a number of important aspects to the present invention.

In accordance with one important aspect of this invention, a novel and improved heavy duty electrical ignition system is provided. The electrode components of the ignition system are relatively large and therefore capable of long-term operation without failure. Further, the burner and ignition components are cooled by the supply of fuel and primary air so that high temperature failures are avoided.

In a first illustrated embodiment, two concentric tubes cooperate to define an inner passage within the inner tube and an annular passage between the two tubes. Fuel is supplied through one passage (the inner passage in the illustrated embodiment) and the oxidant (primary air) is supplied through the other passage.

The two tubes are electrically isolated and each tube constitutes a portion of one electrode of the ignition system. Mounted on the end of the outer tube are electrode elements which extend radially into alignment with the end of the inner tube. Such electrode elements are axially spaced from the end of the inner tube to provide gaps for the igniter. Such gaps extend from the end of the inner tube in alignment therewith.

The fuel and primary air are separated by the inner tube until they pass adjacent and beyond the end of the inner tube. Therefore the fuel and primary air commence to mix at the location of the gap of the igniter. An electrical potential is applied across the gap, causing a spark at the location of the initial mixing of the fuel in the primary air. This provides reliable ignition.

Further, the primary air impinges on the radially extending electrode elements, causing a portion of the primary air to deflect inwardly and ensuring that some fuel primary air mixing occurs at the location of the ignition spark. In fact, the spark itself is blown inwardly into the path of the fuel flow by such inward deflection of the primary air. This structure, therefore, provides reliable ignition. Further, both of the tubes are cooled by the flow of fuel and primary air, so excessive component temperatures are not encountered.

In a second illustrated embodiment, the arrangement of the two concentric tubes is essentially the same as in the first embodiment except that a short sleeve is provided within the outer tube to define an annular outlet passage adjacent the end of the tubular member. The outlet passage has a smaller cross-sectional area than the cross-sectional area between the inner and outer tubes. The end of the short sleeve is flared radially inwardly to constitute an electrode element in the form of a substantially continuous annulus in substantial alignment with the tubular member. If the burner is in a quiescent state with no oxidant or fuel flowing therethrough, the spark may take place at any of a multiplicity of locations between the inner surface of the short sleeve and the outer surface of the inner tube. In use, with fuel and oxidant flowing, the spark is blown to and confined at the end of the inner tube and at any of a multiplicity of locations around a radially inwardly directed edge of the outer tube. Since a spark will tend to follow the shortest path between spaced electrodes, erosion of one part of the outer tube edge will merely result in the spark's moving to another portion of the outer tube edge.

Cross passages are provided through the inner tube to provide a fluid passage between the inner tube and the annular space between the inner tube and the short sleeve. A blocking member in the form of a hex-nut is provided at the discharge end of the inner tube to provide sufficient back pressure in the inner tube to cause a portion of the fluid to flow from the inner tube to the annular space for premixing.

The burner structure in both embodiments provides substantially unobstructed straight-line flow of the primary air and fuel to the combustion location. In addition, the main combustion air is introduced into the combustion zone through an annular opening extending around both the previously described passages. Flow straighteners are provided in the annular passage for the main combustion air so that it enters the combustion zone in a relatively nonturbulent manner surrounding the initial combustion resulting from the ignition of the fuel and the primary air.

By appropriately adjusting the flow rates of the fuel, primary air and main combustion air, substantially any type of flame propagation or combustion can be obtained. For example, when the burner is used in the firing of radiant tubes in gas-fired furnaces, the burner can be adjusted so that the combustion occurs in a relatively long flame extending substantially the entire length of the radiant tube. This creates a condition in which the tubes are heated substantially uniformly for efficient heat transfer. Further differential expansion due to localized excessive heating does not occur and the radiant tubes have longer lives.

When a relatively long flame is desired, the flow rates of the fuel in the two air components are adjusted so that laminar flow is produced. Further, the flow rates are adjusted so that the velocity of each component is substantially the same. In such instance, the mixing of the fuel and the combustion air occurs along a relatively long interface and a long flame results. Conversely, if a more concentrated flame is desired, the rates of flow are adjusted so that turbulent flow occurs for more immediate mixing. Further, even when laminar flow ranges are maintained, the velocity of two adjacent gaseous streams can be adjusted so that different flow velocities are provided. This produces more rapid mixing and the flame length is decreased.

With the present invention, reliable ignition is provided with a structure which is durable and relatively trouble-free. Further, a burner structure is provided which allows the user to establish substantially any flame pattern desired. These and other aspects of this invention are illustrated in the accompanying drawings and are more fully described in the following specification.

DETAILED DESCRIPTION OF THE DRAWINGS

Burners in accordance with this invention may be used in essentially any application where a gaseous fuel is burned, but are particularly suited for use in radiant tube furnaces fired with a gas fuel such as natural gas. Such types of furnaces are more fully described in U.S. Letters Pat. Nos. 4,496,314 and 4,524,752, and such patents are incorporated herein by reference in their entirety.

Figure 1:
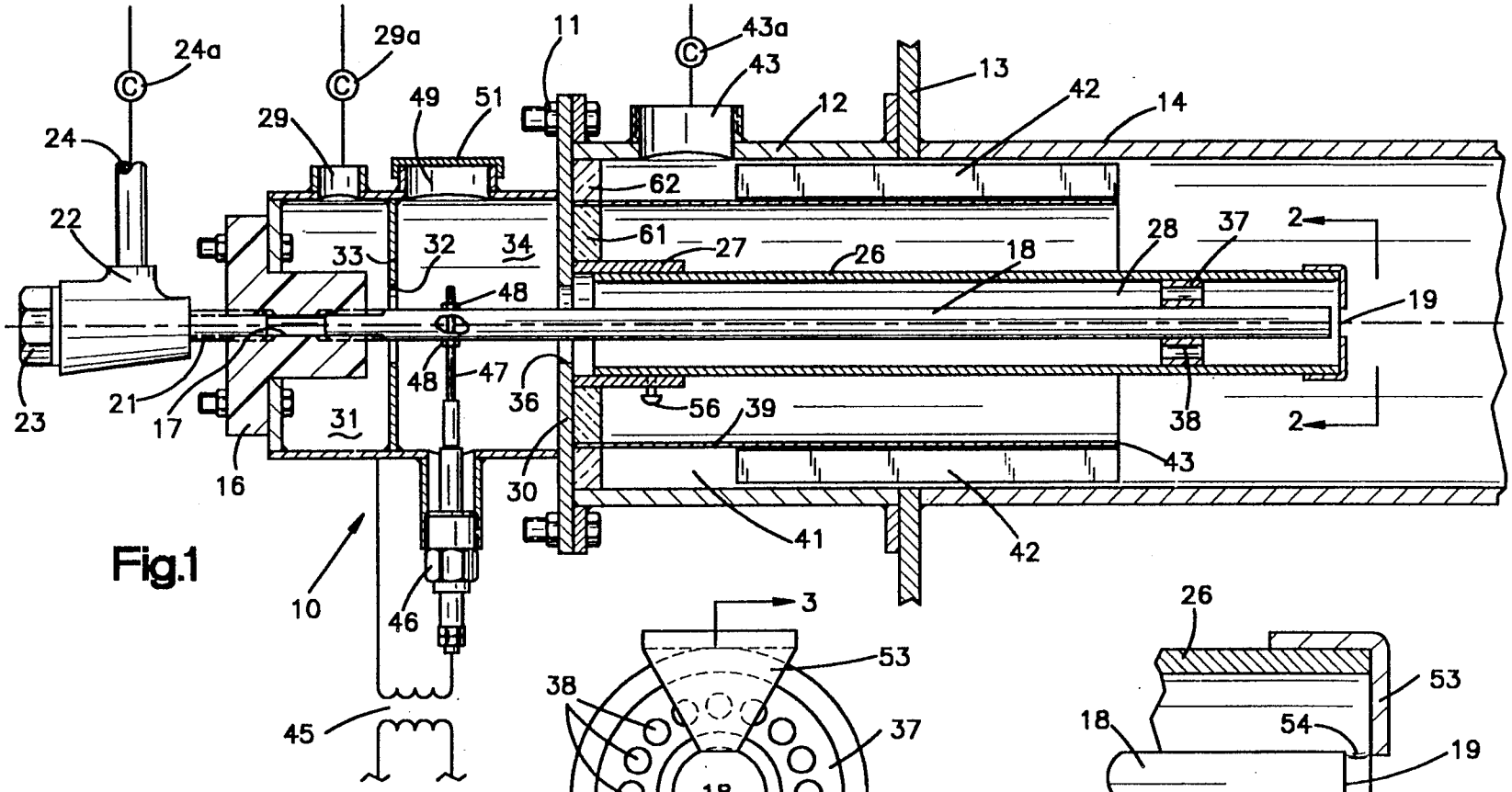
FIG. 1 is a schematic illustration of a burner in accordance with one aspect of the present invention installed in a radiant tube furnace.
Figure 2:
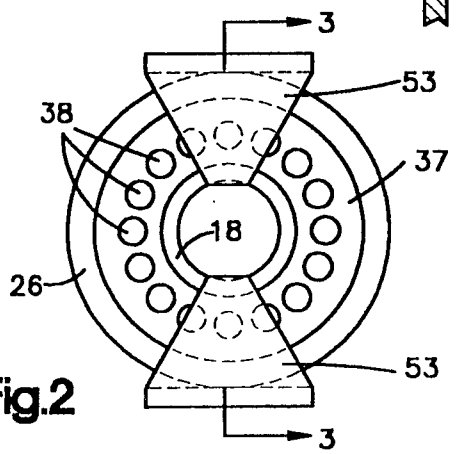
FIG. 2 is an enlarged, fragmentary end view illustrating the structural detail of the burner.
Figure 3:
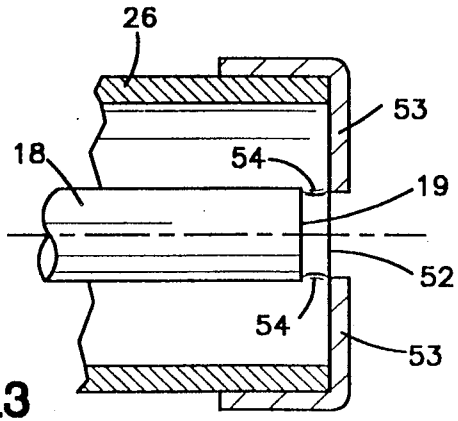
FIG. 3 is an enlarged, longitudinal section taken generally along line 3—3 of FIG. 2.

Referring to FIGS. 1—3 of the drawings, the burner includes a housing assembly 10 secured by fasteners 11 to a mounting sleeve 12 projecting from the wall 13 of a furnace. In the illustrated embodiment, the mounting sleeve 12 is in alignment with and communicates with a radiant tube 14 of the furnace. Such tube may be U-shaped, M-shaped, or any other suitable shape.

Mounted on the end of the housing assembly 10 is an insulator fitting 16 formed of a material which is non-conductive with respect to electricity. The fitting 16 is provided with a threaded passage 17. Threaded into the inner end of the passage 17 is a gas inlet tube 18 which extends to an inner end 19 located in the illustrated embodiment within the radiant tube 14. A close nipple 21 is threaded into the other end of the passage 17 and connects with a T fitting 22. The T fitting has a sight glass 23 aligned with the tube 18, permitting an operator to observe the flame at the end 19 of the tube 18. Gaseous fuel, normally natural gas, is supplied to the T fitting 22 through a fuel inlet pipe 24. The fuel supplied to the burner through inlet pipe 24 passes through the T fitting 22 and flows along the gas inlet tube to the end 19, where it mixes with the primary air and is ignited, as discussed in detail below.

A primary air tube 26 is mounted at its outer end within a sleeve 27 welded onto a mounting plate 30 provided by the housing assembly 10. The primary air tube surrounds the gas inlet tube 18 and cooperates therewith to define an annular passage 28 along which primary air flows to the end of the passage 28. The primary air is introduced into the housing assembly 10 through a primary air inlet 29 directly into a first chamber 31 defined by the housing assembly 10. Such chamber communicates through an opening 32 in a baffle 33 to a second chamber 34 in the housing assembly 10. Such chamber, in turn, communicates with the annular chamber 18 through an opening 36 in the mounting plate 30. A ceramic spacer 37 having a plurality of symmetrically arranged passages 38 therethrough is positioned in the annular passage 28 to support the inner end of the gas inlet tube 18 within the primary air tube 26 to ensure that they remain in a coaxial relationship.

Positioned around the primary air tube 26 within the sleeve 12 is a third tube 39 which cooperates with the mounting sleeve 12 and the adjacent end of the radiant tube 14 to define an annular chamber 41 through which the main combustion air is supplied to the burner. The main combustion air is introduced into the burner through a port 43 in the mounting sleeve 12. At peripherally spaced locations around the tube 39 are axially extending straightening fins 42 which function as flow straighteners so that the flow of the main combustion air exiting from the inner end 43 of the tube 39 tends to enter the burner area in an axially directed manner. The outer ends of the straightening vanes 42 are spaced from the inner ends so that combustion air entering through the port 43 can easily flow entirely around the tube 39.

The gas inlet tube 18 and the primary air tube 26 constitute part of the electrodes of the ignition system. The primary air tube 26 is grounded through the sleeve 27 and the mounting plate 30. The gas inlet tube is electrically isolated from the remainder of the burner by the fitting 16 and the spacer 37.

A source 45 of electrical high potential is connected to a spark plug 46, providing a lead 47 directly connected to the gas inlet tube 18. Opposed nuts 48 threaded onto the lead 47 tightly engage the opposite sides of the tube 18 to ensure that a good electrical connection is provided. The housing assembly 10 is provided with access openings 49 aligned with the lead 47 to provide access to the nuts during the mounting of the spark plug. Such access opening is closed by a cap 51 during the normal operation of the burner.

As best illustrated in FIG. 3, the end 52 of the primary air tube 26 is positioned a small distance beyond the end 19 of the gas inlet tube 18. Mounted on the end of the primary air tube are a pair of opposed electrode elements 53 which extend radially inward from the end 52 of the primary air tube 26 to a position in axial alignment with the end 19 of the gas inlet tube. Consequently a spark gap 54 is provided in alignment with the tube 18 between the end 19 of the gas inlet tube 18 and the inner extremities of the electrode elements 53.

When sufficient electrical potential in the order of 6000–10,000 volts is applied between the gas inlet tube 18 and the primary air tube 26, sparks are established across the spark gaps 54 and provide the ignition of the burner. In the illustrated embodiment, there are two electrode elements 53 located diametrically apart to establish two spark gaps and two spark zones. However it is within the scope of this invention to provide additional electrode elements at other peripherally spaced locations around the tube 26.

The length of the spark gap is adjusted by adjusting the axial position of the primary air tube within the mounting sleeve 27. When the length of the gap is at the desired adjusted length, setscrews 56 are tightened to maintain the desired adjusted position.

The flow of fuel along the interior of the gas inlet tube 18 is unobstructed and relatively smooth flow is provided. The flow of the primary air along the annular passage 28 is substantially unobstructed and also relatively smooth. Also, the flow of the main combustion air past the straightening vane 42 tends to be relatively smooth flow. Therefore, the fuel and the two air components smoothly enter the combustion portion of the burner.

The spark gap 54 extends axially in alignment with the end of the fuel inlet tube, and therefore is positioned at the interface between the primary air and the fuel. Consequently, reliable ignition is obtained. Further, the electrode elements 53 tend to divert some of the primary air in a radially inward direction to create some mixing of the fuel and primary air at such location. This tends to cause the spark to be blown inwardly into the area of initial mixing of the fuel and primary air for very reliable operation.

The electrode elements 53 are substantial in size and are, therefore, not excessively subject to heat erosion. Further, the primary air flowing along the annular passage 28 and the fuel flowing along the tube 18 cooperate to provide cooling for both the tubes and the electrode elements 53.

The baffle 33 in cooperation with the mounting plate 30 and the spacer 37 limit the amount of radiant heat which passes back along the burner toward the insulator fitting 16, thereby preventing the insulator fitting from being exposed to excessive heat. Consequently, the fitting can be formed of plastic materials and need not necessarily be formed of a high temperature ceramic material. Ceramic insulators 61 and 62 are positioned against the forward face of the mounting plate 30 to limit the amount of heat reaching the mounting plate from the combustion area.

In order to control the rate of flow of the fuel, control valve means **24*a* are provided between the fuel source and the fuel inlet pipe 24. Similarly, control valve means 29*a* and 43*a* are provided to respectively control the flow of primary air and main combustion air to the associated inlets 29 and 43**.

In instances in which a long flame is desired, the flow rates of the fuel and the primary and main combustion air are adjusted by the associated controls so that they exit into the combustion area as laminar flow. Further, the flow rates are adjusted so that the velocity of flow of the fuel and air is substantially equal. In such a case, the turbulence is minimized and the fuel tends to mix with the combustion air in a relatively gradual manner, causing the combustion to occur along a substantial length of the tube 14. This reduces the tendency for localized excessive heat to occur in the radiant tubes 14, improves efficiency, and promotes longer tube life.

When it is desired to provide a combustion which is more confined, the rates of flow are adjusted to provide nonlaminar turbulent flow. This causes more immediate mixing of the gas in the combustion air. Further, even when laminar flow is present, the velocity of the air and/or the fuel entering the combustion area can be adjusted to differ one from another, promote mixing, and reduce flame length.

Figure 4:
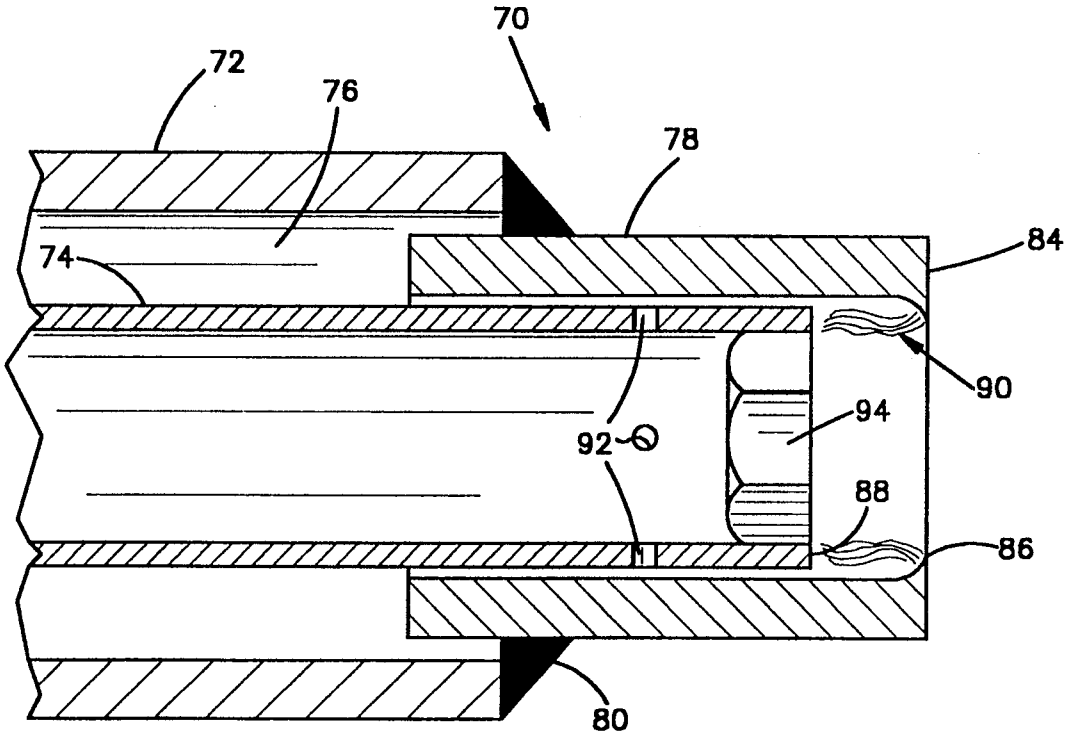
FIG. 4 is an enlarged, fragmentary, sectional view similar to FIG. 3 but showing a further aspect of the present invention.

Referring now to FIG. 4 of the drawings, there is illustrated a burner assembly 70 having a primary air tube 72 which surrounds a gas inlet tube 74. The tubes 72 and 74 cooperate to define an annular passage 76 along which primary air flows to the end of the passage 76. The end of the passage 76 is constricted by a short sleeve 78 which is fixed to the end of the tube 72 by a weldment 80 so that a restricted annular passage 82 is formed between the inside surface of the sleeve 78 and the outside surface of the tube 74.

The gas inlet tube 74 and the primary air tube 72 constitute part of the electrodes of the ignition system. The primary air tube is grounded and the gas inlet tube is electrically isolated from the remainder of the burner in the manner described above with reference to FIGS. 1–3.

The end 84 of the sleeve 78 is provided with a radially inwardly directed lip or annulus 86 which constitutes an electrode element in axial alignment with an end 88 of the tube 74. The annulus may be formed by burnishing or by leaving a burr at the end of the tube 74 after a cutting operation. With air and fuel flowing through the tubes 72 and 74, a spark gap 90 is provided in alignment with the tube 74 between the end 88 of the gas inlet tube 74 and the annulus 86. The spark may tend to travel around the annulus 86 as portions thereof become eroded. Without air and fuel flowing, the spark will tend to wander along the gap between the tube 74 and the sleeve 78, thus preventing erosion damage if the fluids are turned off for relatively long periods without interrupting the electrical potential. When fuel and air are turned on, the spark will be blown to the illustrated position.

Cross ports 92 are provided through the tube 74 to permit some premixing of the fuel and oxidant prior to ignition. To aid in such premixing, a blocking member, such as a hex-nut 94, is press-fitted in the bore of the tube 74 to create back pressure of fuel therein With this invention a simple, reliable burner structure is provided which can function with a minimum of service for extended periods of time. The ignition structure avoids relatively small electrodes and the like which can erode rapidly, particularly in a high temperature environment. Further, the structure is arranged so that the combustion air and the fuel tend to provide substantial cooling of the components of the burner.

Although the preferred embodiment of this invention has been shown and described, it should be understood that various modifications and rearrangements of the parts may be resorted to without departing from the scope of the invention as disclosed and claimed herein.

What is claimed is:

1. A burner having an electrical ignition system, comprising a tubular member having an end and defining a first passage extending to a first passage end at said end of said tubular member, conduit means surrounding said tubular member cooperating therewith to define an annular second passage around the first passage having a second passage end substantially at said end of said tubular member, first supply means for causing fuel to flow along one of said passages and out said end thereof, second supply means causing an oxidant to flow along the other of said passages and out said end thereof, said tubular member isolating and separating said fuel and oxidant flowing along said passages but permitting mixing thereof as they pass adjacent to and beyond said end of said tubular member, and ignition means operating to establish a spark gap extending from said tubular member and in substantial alignment with said tubular member beyond the said end of said tubular member.

2. A burner as set forth in claim 1, wherein said tubular member and conduit means are both cylindrical and coaxial.

3. A burner as set forth in claim 1, wherein said tubular member and said conduit means are electrically isolated from each other, and a high potential electrical source is connected across said tubular member and conduit means.

4. A burner as set forth in claim 3, wherein an electrode element is provided by said conduit means which extends radially inward to inner extremities in alignment with said tubular member, said tubular member and electrode element cooperating to form a spark gap extending from said one end of said tubular member in alignment therewith.

5. A burner as set forth in claim 4, wherein said electrode element provides a wide portion mounted on said conduit means and extends with decreasing width as it extends radially inward into alignment with said tubular member.

6. A burner as set forth in claim 5, wherein a plurality of peripherally spaced electrode elements are provided, each of which cooperates with said tubular member to provide a spark gap in alignment with said tubular member.

7. A burner as set forth in claim 4 wherein said electrode element provides portions projecting into said annular second passage which deflect the flow along said second passage radially inward causing mixing of said fuel and oxidant at said spark gap.

8. A burner as set forth in claim 7, wherein said burner is mounted on a radiant tube furnace in alignment with one end of said radiant tube.

9. A burner as set forth in claim 8, wherein an annular third passage extends around said annular second passage and is substantially coaxial therewith, and a source of main combustion oxidants is connected to supply oxidant to said third passage, the flow along said passages being laminar and at substantially the same velocity causing combustion to occur along a substantial length of said radiant tube.

10. A burner as set forth in claim 1, wherein control means are provided to separately regulate the flow rate of said fuel and said oxidant.

11. A burner as set forth in claim 10, wherein said control means are adjusted to establish laminar flow of said fuel and oxidant at substantially the same velocity.

12. A burner as set forth in claim 10, wherein said control means are adjusted to produce turbulent flow of at least one of said fuel and oxidant.

13. A burner as set forth in claim 3, wherein an electrode element is provided by said conduit means which extends radially inwardly and which forms a substantially continuous annulus in substantial alignment with said tubular member, said tubular member and electrode element cooperating to form a spark gap extending from said one end of said tubular member in substantial alignment therewith.

14. A burner as set forth in claim 13, wherein said annulus comprises a radially inwardly directed edge of said conduit means.

15. A burner as set forth in claim 13, wherein said conduit means has an end portion which defines an annular outlet passage adjacent said end of said tubular member having a cross-sectional area which is less than the cross-sectional area of said annular second passage.

16. A burner as set forth in claim 15, wherein cross passage means are provided in said tubular member between said first passage and said outlet passage.

17. A burner as set forth in claim 16, wherein blocking means is provided within said first passage at said end of said tubular member to partially impede the flow of fuel or oxidant therethrough and cause a portion of said fuel or oxidant to flow radially outwardly through said cross passage means and into said annular outlet passage.

18. A burner as set forth in claim 17, wherein said blocking means is a hex-nut.

19. A radiant tube furnace comprising a radiant tube, a burner mounted at one end of said radiant tube in alignment therewith, said burner providing an inner first passage, an annular second passage around said first passage and coaxial therewith, an annular third passage around said second passage coaxial therewith, one of said first and second passages being supplied with gaseous fuel, the other of said first and second passages being supplied with a primary oxidant, said third passage being supplied with a main supply of oxidant, the fuel and primary oxidants being separated until they pass adjacent to and beyond the end of said first passage and being allowed to mix as they pass adjacent to and beyond said end of said first passage, the flow of fuel and oxidant being laminar and at substantially the same velocity causing combustion to occur along a substantial length of said radiant tube and electric ignition means provided at the end of said first passage to produce a spark in axial alignment with an interface of the gaseous fuel and primary oxidant discharged from said first and second passages.

20. A radiant tube furnace as set forth in claim 19, wherein straightening means are provided in said third passage and said third passage is spaced radially from said second passage.

21. A radiant tube furnace as set forth in claim 19, wherein adjustable flow control means are provided to adjust the flow rate of fuel and oxidant.

22. A burner having an electrical ignition system comprising conduit means causing separated parallel flow of gaseous fuel and an oxidant to an ignition zone, said conduit means allowing contact between said fuel and oxidant at an interface aligned with said parallel flow at said ignition zone, and spark generating means providing an ignition spark extending along said interface operable to ignite said fuel and oxidant.

23. A burner as set forth in claim 22, wherein said conduit means define a first passage and a second annular passage around said first passage, one of said passages conducting fuel and the other of said passages conducting oxidant and creating an annular interface at said ignition zone, said spark generating means producing a plurality of sparks extending along said interface.

24. A method of igniting fuel and oxidant comprising causing separated parallel flow of a gaseous fuel and an oxidant to an ignition zone, contacting said fuel and oxidant at an interface along a predetermined path aligned with said parallel flow at said ignition zone, and providing an ignition spark which extends along said interface.

25. A method as set forth in claim 24, including separating said fuel and oxidant with a first conduit having an outlet end beyond which is said ignition zone, and providing said spark between said outlet end and an electrode aligned with said outlet end.

26. A method as set forth in claim 25, including providing a second conduit around said first conduit cooperating therewith to define a passage for one of said fuel and oxidant around said first conduit, and using said second conduit for at least part of said electrode.

* * * * *